US009021673B2

(12) United States Patent
Ray

(10) Patent No.: US 9,021,673 B2
(45) Date of Patent: May 5, 2015

(54) SNAKE GLOVE

(76) Inventor: Steven Ray, Palisades Park, NJ (US)

( * ) Notice: Subject to any disclaimer, the term of this patent is extended or adjusted under 35 U.S.C. 154(b) by 432 days.

(21) Appl. No.: 13/360,006

(22) Filed: Jan. 27, 2012

(65) Prior Publication Data

US 2012/0216330 A1 Aug. 30, 2012

Related U.S. Application Data

(60) Provisional application No. 61/460,757, filed on Feb. 26, 2011.

(51) Int. Cl.

| | |
|---|---|
| ***B25B 27/00*** | (2006.01) |
| ***B25B 31/00*** | (2006.01) |
| ***A41D 19/00*** | (2006.01) |

(52) U.S. Cl.

CPC ..... *B25B 31/00* (2013.01); *Y10T 29/53909* (2015.01); *Y10T 29/49824* (2015.01); *B25B 27/00* (2013.01); *A41D 19/0037* (2013.01)

(58) Field of Classification Search

CPC ..... B23Q 3/00; B23Q 3/155; B23Q 3/157; B23Q 7/04; B23Q 11/00; B25B 27/00; B25B 28/00

USPC ..... 29/270, 255, 278, 282

See application file for complete search history.

(56) References Cited

U.S. PATENT DOCUMENTS

| | | | | | |
|---|---|---|---|---|---|
| 2,880,435 | A | * | 4/1959 | Deutsch et al. | 15/104.33 |
| 3,703,007 | A | * | 11/1972 | Stewart | 2/163 |
| 4,232,419 | A | | 11/1980 | Sanger | |
| 4,351,067 | A | | 9/1982 | Bartels | |
| 4,887,929 | A | * | 12/1989 | Hale | 403/328 |
| D360,647 | S | * | 7/1995 | Jimenez | D17/20 |
| 5,492,046 | A | * | 2/1996 | Jimenez | 84/319 |
| 5,651,273 | A | * | 7/1997 | Levy | 63/15.7 |
| 5,981,856 | A | * | 11/1999 | Story | 84/319 |
| 6,126,359 | A | | 10/2000 | Dittrich | |
| 6,401,253 | B2 | | 6/2002 | Brunson | |
| 2005/0076048 | A1 | | 4/2005 | Petkovich | |
| 2008/0135676 | A1 | | 6/2008 | Hafner | |
| 2010/0188326 | A1 | * | 7/2010 | Dines | 345/156 |
| 2012/0216330 | A1 | * | 8/2012 | Ray | 2/160 |

* cited by examiner

*Primary Examiner* — Lee D Wilson

(74) *Attorney, Agent, or Firm* — Law Office of David J. Rosenblum

(57) ABSTRACT

A bayonet-connection-undoing device includes a projection configured for attachment to a hand so as to extend therefrom for depressing a pin to undo a bayonet connection. The device may have a finger ring to which the projection is attached, in which case the attachment to the hand can be made by wearing the ring on the hand, optionally the ring being disposed inside a hand glove, with the projection emerging from the glove. Alternatively or in addition, the device may further include sections of a pipe cleaner, the connection, and the pin which is configured for mutually fixing one of the sections to another. In this case, the depressing is down into a position at which the pin is retracted out of the connection and maintained, without need for the depressing, in a contracted state by relative movement of the sections.

15 Claims, 5 Drawing Sheets

SNAKE GLOVE

CROSS-REFERENCE TO RELATED APPLICATIONS

This application claims the benefit under 35 USC §119(e) of U.S. Provisional Patent Application No. 61/460,757, filed Feb. 26, 2011 by the present inventor, the entire disclosure of which is incorporated herein by reference.

FIELD OF THE INVENTION

The present invention relates to undoing a bayonet connection and more particularly, to attaching a projection usable for this purpose.

BACKGROUND OF THE INVENTION

U.S. Pat. No. 2,880,435 to Deutsch et al. (hereinafter "the '435 patent"), the entire disclosure of which is incorporated herein by reference, discloses a pipe cleaning cable or "sewer snake" that can be advanced through a sewer pipe as sections of the snake are added on in series. Also disclosed is a wrench for detaching sections when the sewage work is complete. This apparatus is now well known in the industry, and the wrench is typically called a "cable key."

As set forth in the '435 patent, a cleaning cable 20, best seen here in FIG. 1A and also described with reference to FIGS. 1B-1G, is made up of sections 21 which are joinable one end to another, in series. The assembly is done according to the total length of cable required during the cleaning process. The cleaning cable 20 is adapted to be rotatably moved as it is wormed through a pipe during the cleaning process. Each section 21 comprises an elongate inner helical member 22 and an elongate outer helical member 24. The outer helical member 24 is, at one end, rigidly attached to a male coupler 28. At the other end, it is rigidly attached to a hollow, cylindrical device serving as a female coupler 30. The attachments are by means of threaded engagement with a hollow threaded extension 31 provided on the male coupler 28 and a hollow threaded extension 32 on the female coupler 30. Each end of the inner helical member 22 is attached to an end of a radially surrounding outer helical member 24 by means a respective coupler 28, 30.

The convolutions of the outer helical member 24 that are adjacent to the threaded extensions 31, 32, to thereby engage them, are in juxtaposed relation; whereas, the intermediate convolutions of the outer helical member 24 that span the cable 20 from section joint to section joint are spaced apart to aid in the pipe cleaning process. In particular, a cutting tool may be attached to a coupler at the end of the most remote section 21 of a series of sections. Various types of cutting tools may thereby be attached. As the cutting tool rotatably removes material from an obstruction in a pipe, much of the cut material is carried back out of the pipe by the convolutions of the outer helical member 24 as the cable 20 is rotated.

Even though the cleaning cable 20 remains in substantially the same shape and form, regardless of the torque load applied to it, the cleaning cable is very flexible. This is due to the fact that it comprises flexible helical members 22, 24. It is, therefore, possible to maneuver the cleaning cable 20 through a number of bends, turns and angles as it follows the inner surface of a pipe during the cleaning process.

The male coupler 28 is provided with a flange 50 separating a cylindrical portion 51 from the threaded extension 31. A fixed pin 52, seen also in FIG. 1B for example, is disposed adjacent the end of the cylindrical portion 51. The pin 52 extends diametrically through the portion and projects from it. The end of the cylindrical portion 51 is provided with a tapered portion 53, seen in FIG. 1C.

Intermediate the fixed pin 52 and the flange 50 is a locking pin 54, shown best in FIG. 1D. The locking pin 54 is disposed in a plane substantially parallel to the plane of the fixed pin 52. The locking pin 54 is recessed in a cavity 55 which is closed by a cover 56. The cavity 55 contains a spring 57 which biases the locking pin 54 outwardly.

The coupler 30 is provided with a socket 58 adapted to receive the cylindrical portion 51 of the coupler 28 of another section 21 of the cleaning cable 20. The coupler 30 is provided with diametrically disposed L-shaped slots 60 which are adapted to receive the protruding ends of the fixed pin 52. The inner edge of the mouth of the socket 58 has a beveled portion 62. The beveled portion 62 is adapted to engage the resiliently mounted locking pin 54 and to force it into the cavity 55 against the biasing pressure of the spring 57 as the cylindrical portion 51 is inserted into the socket 58.

The tapered end 53 at the end of the coupler 28 aids in aligning the cylindrical portion 51 with the socket 58. As stated above, the couplers 28, 30 are attachable one to the other as sections 21 of the cable 20 are added one to the other in series relation. The fixed pin 52 of the male coupler 28 is directed through the L-shaped slots 60 as the cylindrical portion 51 of the male coupler is inserted into the female coupler 30. The resiliently mounted locking pin 54 is forced downwardly into the cavity 55 of the cylindrical portion 51 of the female coupler 30 as the cylindrical portion 51 of the male coupler 28 is inserted into the socket 58 of the female coupler 30.

When the fixed pin 52 has abuttingly engaged the end of the longitudinal legs of the L-shaped slots 60 and slidingly progressed through them sufficiently, the male coupler 28 may be rotated, moving the pin 52 along the transverse leg portion of the L-shaped slots. This is best visualized from comparing FIG. 1A to FIG. 1E. As the fixed pin 52 approaches the ends of the transverse legs of the L-shaped slots 60, the locking pin 54 reaches the opening provided by the longitudinal leg of one of the L-shaped slots. The resiliently mounted locking pin 54 is thereby permitted to snap upwardly into the slot 60.

When the locking pin 54 has snapped upwardly, the female coupler 30 is locked to the male coupler 28. This is due to the fact that: a) the locking pin 54 and one of the projections of the fixed pin 52 are disposed in one of the L-shaped slots 60; and b) the other projection of the fixed pin 52 is positioned in the other L-shaped slot. Therefore, the male coupler 28 may not be rotated with respect to the female coupler 30 until the locking pin 54 has been depressed, permitting the locking pin to engage the inner walls of the socket 58 of the female coupler and allowing the fixed pin 52 to move within the L-shaped slots 60. Thus, a spring-loaded bayonet type of joint, or "bayonet connection" 61, is provided to mutually fix the couplers 28, 30 to each other.

The male coupler 28 is manually attachable to the female coupler 30 as follows. The portion of the section 21 is grasped near the female coupler 30. With the other hand, the portion of the other section 21 is grasped near the male coupler 28. The hands are brought together so that the cylindrical portion 51 of the male coupler is inserted into the socket 58 of the female coupler with the fixed pin 52 moving through the slots 60. As the fixed pin 52 moves through the slots 60, the locking pin, by means of the bevel portion 62, is urged downward into a contracted state 64, represented by the downward arrow in FIG. 1D. It is maintained in the contracted state 64 by the closely surrounding inner wall of the socket 58. This clearance permits the cylindrical portion 51 to slide further within the socket 58. When the fixed pin 52 reaches the transverse legs of the L-shaped slots, the male coupler 28 is then rotatable within the socket 58 so that the fixed pin 52 follows the transverse legs. A slight amount of this rotation then allows the locking pin 54 to emerge in the longitudinal leg of one of the slots 60 and thereby lock within that slot. The locking pin 54 is then in a "locked state." A number of sections 21 can thereby be assembled in series.

When it is desired to uncouple the female coupler 30 from the male coupler 28, a disassembly wrench 93, seen from FIG. 1F, may be employed to undo the bayonet connection 61. The wrench 93 has, at one end, an arcuate portion 94 that is terminated with an inward projection 95. For the uncoupling operation, the wrench 93, as seen in FIG. 1G, is fitted to the couplers 28, 30. This is typically done with the wrench 93 being held in one hand. In particular, the arcuate portion 94 surroundingly engages the female coupler 30, with the projection 95 forcibly depressing the locking pin 54 below, or possibly flush with, the outer surface 97 of the cylindrical portion 51 of the male coupler 28. Thus, the locking pin 54 is now in a depressed, or "unlocked", state. The other hand now grasps, or continues to grasp, the other section 21 which provides the male coupler 28. The wrench 93 is therefore usable torque-wise to axially twist the two sections 21 with respect to each other. The rotation maintains the locking pin 54 in the contracted state 64 even when, by virtue of the rotation, the locking pin is no longer in contact with the projection 95. As the rotation progresses, it brings, relatively speaking, the fixed pin 52 along the transverse legs of the L-shaped slots 60. Ultimately, the fixed pin 52 reaches alignment with the longitudinal legs of the L-shaped slots 60. At this stage, the hand holding the wrench 93 can switch to grasping the section 21 attached to the female coupler 30. With the slot 60 thereby cleared of the projection 95 and with the fixed pin 52 free to be slid through the respective open ends of the longitudinal legs of the slots 60, the fixed pin is withdrawn through the slots by manually pulling the two sections 21 apart.

With the two sections 21 now uncoupled, the section that provided the female coupler 30 is pulled to let another bayonet connection 61 emerge from the pipe.

The operation is now repeated. This involves picking up the wrench 93 once again. The other hand grasps the section 21 providing the male coupler 28 (i.e., the same section that provided the female coupler 30 in the just-previous joint uncoupling step). The wrench 93 is used to relatively twist the sections 21 into position. At this point the wrench is manually released. The releasing hand grabs the section 21 just rotated by the wrench 93. The sections 21, one in each hand, are pulled apart manually.

The complete operation of withdrawing more of the pipe cleaner 20, picking up the wrench 93, using it, putting it down, and pulling the sections 21 apart continues until the entire pipe cleaner is disassembled.

SUMMARY OF THE INVENTION

The present inventor has made the following observations concerning disassembly of the pipe cleaner 20. Picking up and putting down the wrench 93 with each emerging section 21 is inconvenient and slows down the process. Also, the wrench 93 is cumbersome and difficult to use. In addition, the wrench 93, as a separate tool, can be lost or misplaced during disassembly, especially among the cut material carried back out of the pipe. There is a need to simplify, speed up and facilitate the disassembly process.

In accordance with an aspect of the present invention, a bayonet-connection-undoing device includes a projection configured for attachment to a hand so as to extend therefrom. The extension is for depressing a pin to undo a bayonet connection.

In a sub-aspect, the device includes a finger ring to which the projection is attached. The attachment to the hand can be made by wearing the ring on the hand.

In a further sub-aspect, the projection is fixed to the ring.

In a yet, further sub-aspect, the projection is formed integrally with the ring.

In a complementary sub-aspect, the ring is disposed inside a hand glove, with the projection emerging from the glove.

In a different sub-aspect, the device comprises a hand glove from which the projection extends.

In one other different sub-aspect, the device includes a finger sheath from which the projection extends. The sheath may be for a thumb, and the extension may occur from a distal joint of the thumb.

In accordance with another sub-aspect, the projection is longitudinally aligned with the sheath.

Alternatively or in addition, a ring to which the projection is attached is sewn inside the sheath.

As one extra alternative, the projection is rectangular in cross-section, as outlined in planes perpendicular to a longitudinal direction of the sheath.

As one other sub-aspect, the pin, in making the connection, resides in a slot the projection is configured, in cross-section, for entering for the depressing.

In one context, the connection mutually fixes two sections of a pipe cleaning apparatus.

In a specific sub-aspect, the projection protrudes with a length sufficient for the depressing flush with or below a surface that surrounds the pin. The surface is radially surrounded by a cylindrical device slotted for accommodating the pin in making the connection.

In a further, specific sub-aspect, the projection has a base at a glove from which the projection extends. The length is such that the depressing brings a portion of the glove at the base flush with an outer surface of the cylindrical device.

As one general sub-aspect, the extension is grip-wise inward.

As yet another sub-aspect, the connection is a spring-loaded bayonet connection.

In some applications and as a sub-aspect, a bayonet-connection-undoing system which includes the device further includes the connection and sections of a pipe cleaner. The connection includes the pin and is configured for mutually fixing one of the sections to another. The depressing is down into a position at which the pin is retracted out of the connection and maintained, without need for the depressing by the projection, in a contracted state by relative movement of the sections.

In a further sub-aspect of the above, a section has an L-shaped slot with a longitudinal leg and a transverse leg. The projection when applied has a length along the longitudinal leg not greater than that of the longitudinal leg exclusive of the transverse leg.

From another standpoint, a mould is configured for forming a projection for depressing a pin to undo a bayonet connection and for forming a finger ring to which the projection is fixed. The forming is such as to mutually form the ring and the projection integrally.

The invention likewise in some aspects entails a method for separating two sections. The method includes, while grasping one of the sections with a hand to which a projection is attached, applying the projection to undo a bayonet connection that fixes that one section to the other.

The method may entail using, during the applying, both hands to twist one section with respect to the other, and continuing to twist to maneuver the sections into a state in which they are mutually separable, at which point the hands are moved apart to perform the separating.

This may further involve the continuing and moving being performed while maintaining a grasp of the one section with the above-mentioned hand, and of the other section with the other hand, the grasps being maintained having existed during said using.

Details of the novel bayonet-connection-undoing device and method are set forth further below, with the aid of the following drawings, which are not drawn to scale.

DETAILED DESCRIPTION OF EMBODIMENTS

The pipe cleaner of FIG. 1, when used to clean out a sewer pipe, is typically handled with gloves.

Figure 2:
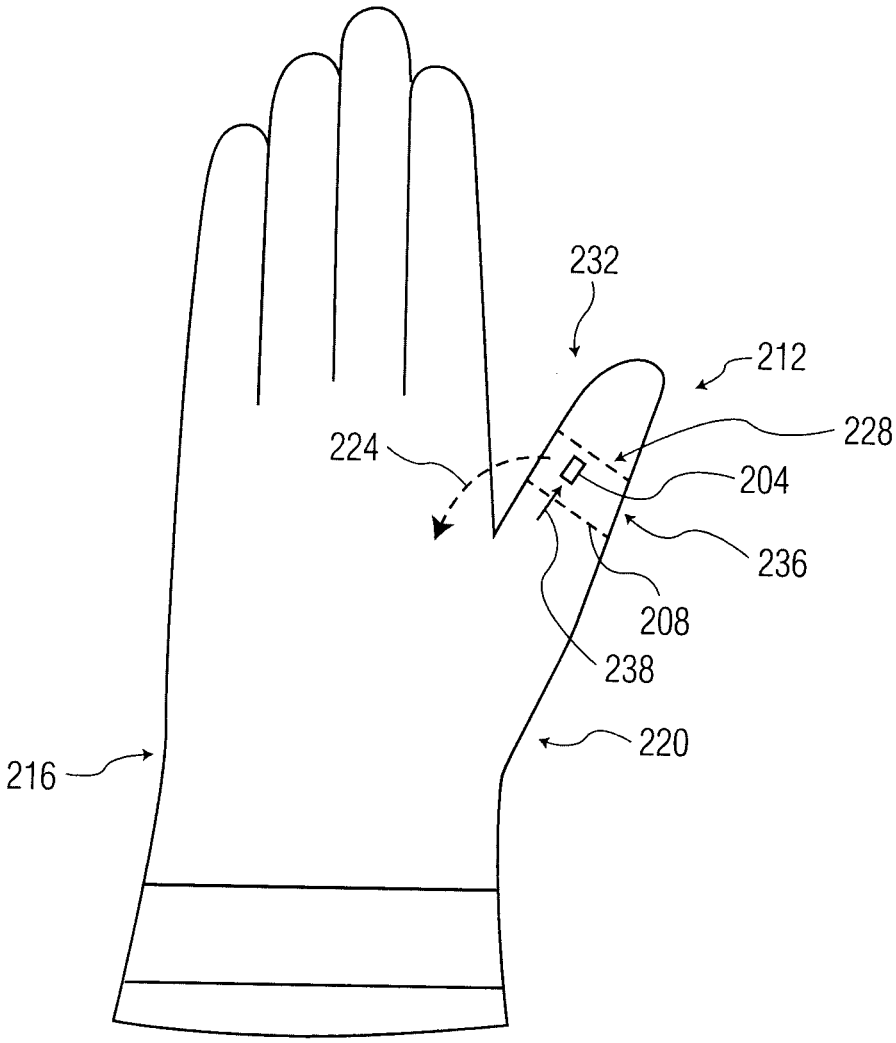
FIG. 2 is a full-length view of an exemplary hand glove combined with a ring and a projection.

Although the scope of the present invention is not limited to the use of a hand glove, or even to pipe cleaning, an application of the present invention using a hand glove is seen in FIG. 2.

Figure 1A:
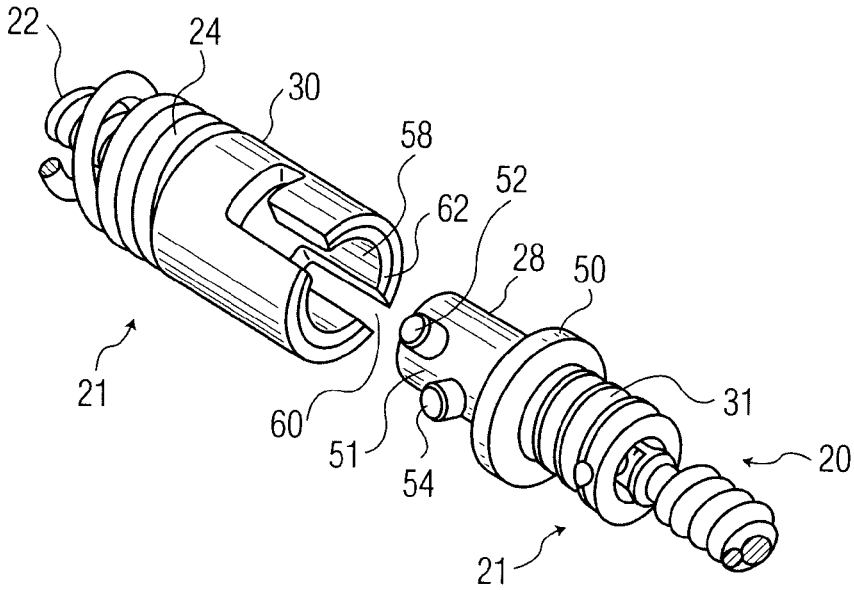
FIG. 1A PRIOR ART
FIGS. 1A-1G are schematic diagrams of a conventional pipe cleaner and a conventional disassembly wrench.
Figure 1B:
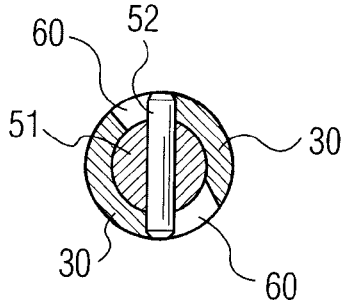
FIG. 1B PRIOR ART
Figure 1C:
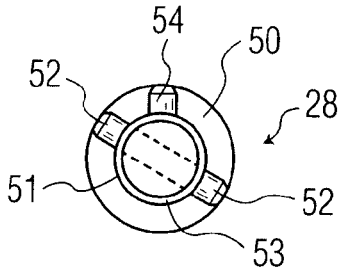
FIG. 1C PRIOR ART
Figure 1D:
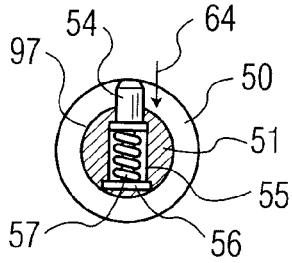
FIG. 1D PRIOR ART
Figure 1E:
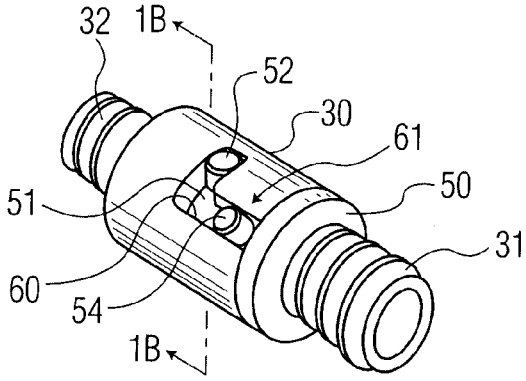
FIG. 1E PRIOR ART
Figure 1F:
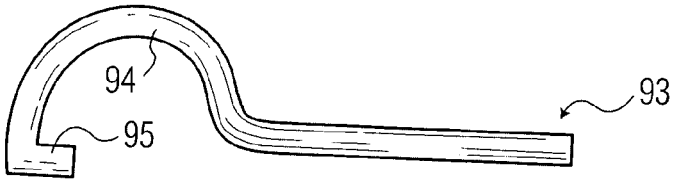
FIG. 1F PRIOR ART
Figure 1G:
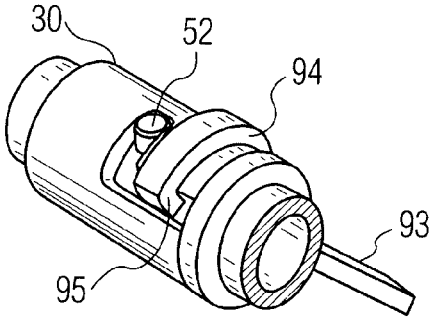
FIG. 1G PRIOR ART

A bayonet-connection-undoing device, or "projection", 204 stems from a ring 208 to emerge through an opening in a finger sheath 212 of a glove 216. The glove 216 is for wearing on a hand 220 of a person disassembling the pipe cleaner 20. FIG. 2 does not show the hand 220, but represents that the palm of the hand is facing the viewer. Accordingly, the projection 204 emerges from the glove 216 grip-wise inwardly, as represented by the arrow 224. The ring 208 underlies the glove 216, as indicated by the dashed lines 228. The sheath 212 is for a thumb 232 (not shown). The opening, and therefore the extension of the projection 204, is from the distal joint 236 of the thumb 232. The projection 204 is longitudinally aligned 238 with the sheath 212. However, in some embodiments, the projection 204 might not be longitudinal. Nor need it be rectangular. It can also be circular in cross-section, like the locking pin 54 it depresses as best seen in FIGS. 1A and 1E. Also, the sheath 212 may be for another finger, such as for the index finger. Alternatively, the projection 204 can extend from other than a finger—from the palm for example.

The glove, when used with a pipe cleaner that is a sewer snake, can be made of leather. Although, another material may be chosen that is sufficiently rugged for handling the pipe cleaner 20, and hygienically impervious to the material being cleaned out of the pipe. The projection 204 can be made of any material having sufficient inflexibility so as to be applied to the undo the bayonet connection 61. The ring 208 can be of any known and suitable substance such as plastic or metal, and can be formed integrally of the same material used in making the projection 204.

The projection 204 is attached to the hand 220 when the glove 216 is worn. In particular and by way of example, the projection 204 may be attached to, and project from, the outside perimeter of the ring 208. The attachment between the ring 208 and the projection 204 may be fixed, such as if the ring and the projection are formed integrally. The ring 208 can be sewn into the inside of the finger sheath 212 for the thumb 232, with the projection 204 emerging from the opening. Thus, while wearing the glove 216, the user can, by moving the thumb 232, apply the projection 204 to undo the bayonet connection 61. The user can, after twisting the sections 21 sufficiently, then lift up the thumb 232 to provide clearance in the slot 60 for the sliding fixed pin 52. The lifting up is done once the fixed pin 52 reaches alignment with the longitudinal legs of the L-shaped slots 60. The sliding past where in the slot 60 the projection 204 was applied then occurs with pulling apart of the two sections 21.

Figure 3A:
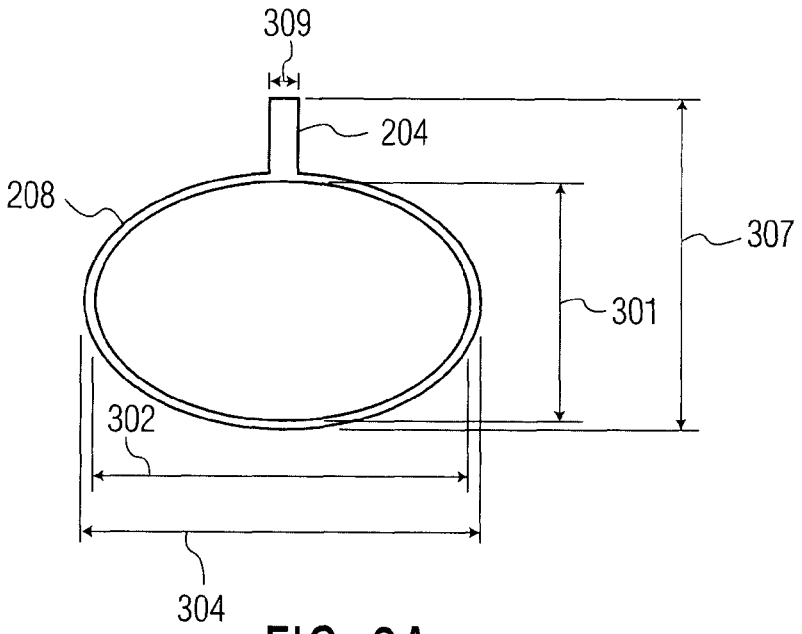
FIGS. 3A, 3B are schematic diagrams of respectively a sectional and lateral view of possible configurations for the ring and the projection of FIG. 2.

The ring 208, as seen from the cross-sectional diagram of FIG. 3A, may be oval-shaped, although other shapes such as circular are possible.

Figure 3B:
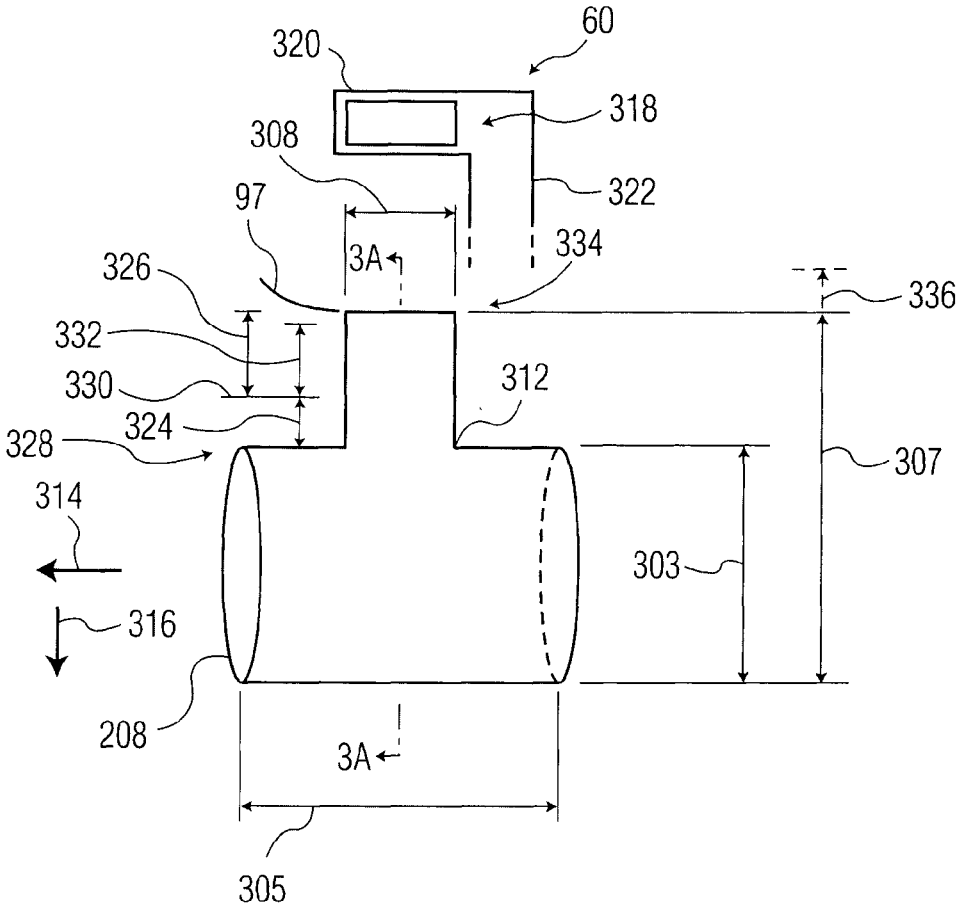

Exemplary dimensions are as follows, with reference to the FIGS. 3A, 3B. The minor-axis inner diameter 301 measures 0.870 inches. The major-axis inner diameter 302 measures 0.995 inches. The minor-axis outer diameter 303 is 1.000 inches. The major-axis outer diameter 304 is 1.125 inches. The axial length 305 of the ring is 1.000 inches. The straight-line, full height 307 from the top of the projection 204 through the centerline of the projection, the center of the ring 208, to the outer surface of the ring is 1.500 inches. The length 308 of the projection 204 is 0.380 inches. The width 309 of the projection 204 is 0.210 inches.

The thumb 232 is insertable into the ring 208 leftward, as indicated by the leftward arrow 314, into an operable position with the nail of the thumb facing down, as shown by the downward arrow 316. A cross-section 318 of the projection 204 is depicted within a longitudinal leg 320 of a slot 60. The cross-section 318 has the length 308 and width 309 indicated. The cross-section 318 is representative of the projection 204 depressing, by action of the thumb 232, the locking pin 54 into the contracted state 64. Also shown is a transverse leg 322 of the slot 60. The glove 216, at for example the thumb sheath 212 at the base 312 of the projection 204, has a thickness 324, seen in FIG. 3B. The portion of the projection 204 that emerges through the glove opening has a protruding length 326 by which the bayonet connection 61 can be undone. In applying the projection 204, the thumb sheath 212 may be placed flush 328 with the outer surface 330 of the socket 58. The socket 58 has a thickness 332, best seen in FIG. 1A as the thickness of the near one of the L-shaped slots 60. When the projection 204 is applied with the thumb sheath 212 flush against the outer surface 330 of the socket 58, the protruding length 326 is of sufficient magnitude if the tip of the projection 204 is flush 334 with the outer surface 97 of the cylindrical portion 51. Here, "flush" is used in the sense that, if the circumference of a circle is pressed inwardly to somewhat or fully flatten it along some small sector, the flattened portion is regarded as flush with the circumference. The protruding length 326 thereby puts the locking pin 54 in the contracted state 64. This provides clearance for relative rotation of the socket 58 and the cylindrical portion 51. The protruding length 326 may also be greater, such that the locking pin 54 is depressed below the outer surface 97, as for example when the projection 204 is circularly dimensioned to match the locking pin. In this case too, clearance is provided. A differential making the protruding length 326 greater, in this context, is shown in FIG. 3B by an arrow 336 having a broken line.

Figure 4:
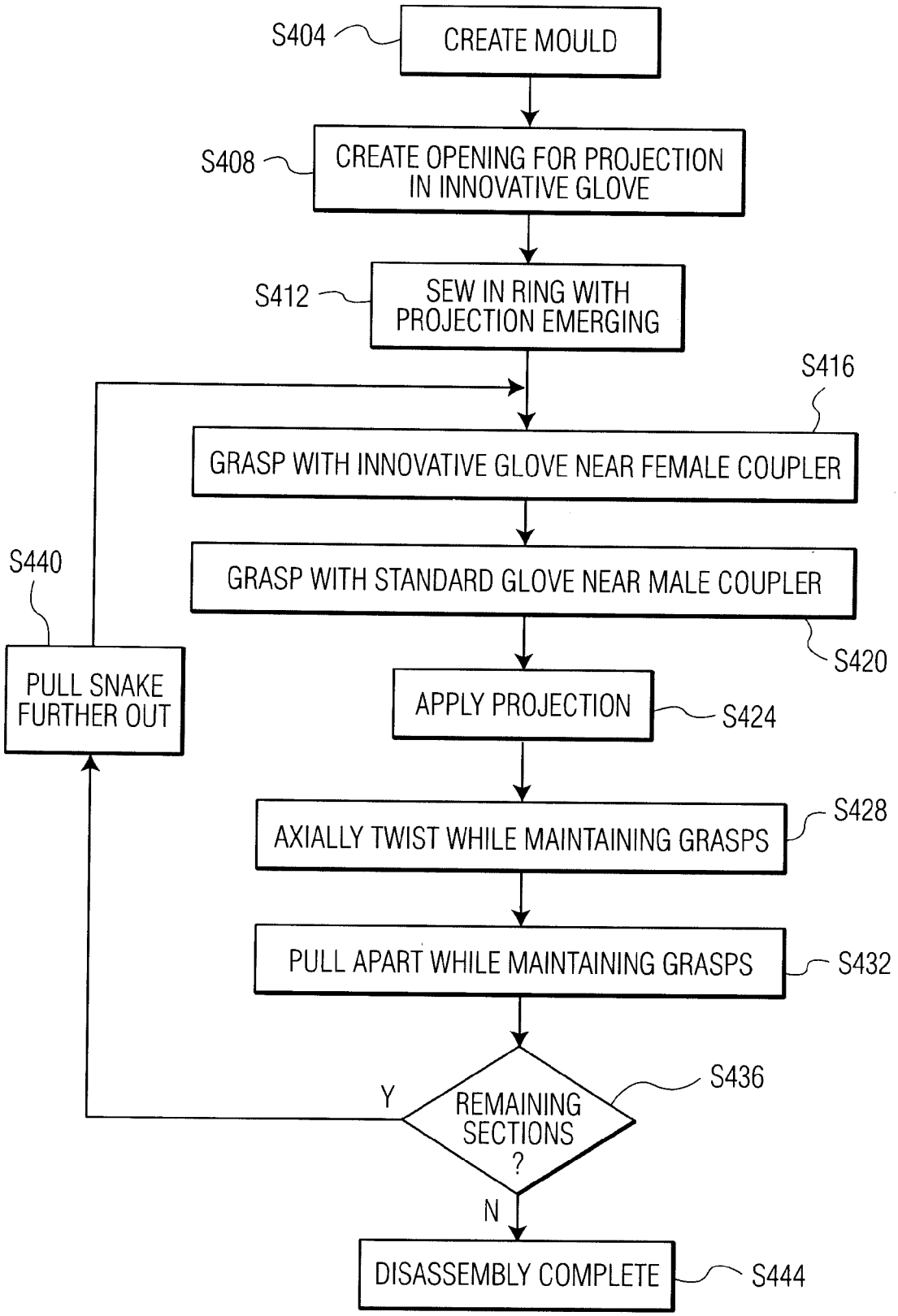
FIG. 4 is a flow chart illustrative, by way of example, of how to make and use a particular version of a bayonet-connection-undoing device.

An exemplary procedure 400 for how to make and use the bayonet-connection-undoing device 204 is shown in FIG. 4. A mould is created for the ring 208 and integral projection 204 (step S404). An opening is created in the grip-wise inward portion of the thumb 232 of the glove 216 at the distal thumb joint 236 (step S408). These two steps can be done in either order or simultaneously. Then, the ring made in step S404 is sewn inside the thumb 232 of the glove 216, with the projection 204 emerging from the opening (step S412).

Now, the resulting device can be used in undoing the bayonet connection 61. The hand wearing the glove 216 holds a portion of the section 21 near its female coupler 30. The glove 216 may be placed on the pipe cleaner 20 such that the thumb 232 is, or is nearly, longitudinally aligned with the longitudinal legs 320 (step S416). The other hand holds a portion of the other section 21 near its male coupler 28 (step S420). By movement of the thumb 232, the projection 204 is applied to depress the locking pin 54 into a contracted state 64, i.e., with the locking pin flush with or below the surface 97 of the cylindrical portion 51 (step S424). The latter two steps S420, S424 can be performed in either order or simultaneously. With both hands continuing to grasp the pipe cleaner 20 in the above-described manner, the user uses both hands to axially twist to thereby bring the fixed pin 52 into alignment with the longitudinal legs 320 of the L-shaped slots 60 (step S428). While still maintaining the grasps with both hands, the two sections 21 are manually pulled apart (step S432). Accordingly, one of the two sections 21 is separated at its male coupler 28 from the rest of the pipe cleaner 20. At this point, if there is any section 21 remaining to be disassembled (step S436), the pipe cleaner 20 is pulled further out of the pipe (step S440), and the disassembly repeats, starting with the first step S416. Otherwise, if no section 21 remains to be disassembled (step S436), the process 400 is complete (step S444).

Advantageously, there is no need to pick up, or to release, a separate tool such as a wrench with each disassembly of a section. Application of the projection 204 is easy and quick, using thumb motion. For any given section 21, disassembly is performed without the need for releasing the grip of either hand. Therefore, disassembly of the pipe cleaner 20, section by section, is performed over a series of sections 21 quickly and conveniently.

A bayonet-connection-undoing device includes a projection configured for attachment to a hand so as to extend therefrom for depressing a pin to undo a bayonet connection. The device may have a finger ring to which the projection is attached, in which case the attachment to the hand can be made by wearing the ring on the hand, optionally the ring being disposed inside a hand glove, with the projection emerging from the glove. Alternatively or in addition, the device may further include sections of a pipe cleaner, the connection, and the pin which is configured for mutually fixing one of the sections to another. In this case, the depressing is down into a position at which the pin is retracted out of the connection and maintained, without need for the depressing, in a contracted state by relative movement of the sections. A method for separating two sections includes, while grasping one of the sections with a hand to which a projection is attached, applying the projection to undo a bayonet connection that fixes the one section to the other.

While the invention has been illustrated and described in detail in the drawings and foregoing description, such illustration and description are to be considered illustrative or exemplary and not restrictive; the invention is not limited to the disclosed embodiments.

For example, a ring may be attached or fixed inside a finger sheath of a hand glove, such as a thumb sheath, by a method other than by sewing or merely sewing. An example would be a sheath having a separate ring-containing compartment. The ring could also be glued directly to the inside of the sheath, or the compartment could be fixed to the inside of the sheath by gluing.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The mere fact that certain measures are recited in mutually different dependent claims does not indicate that a combination of these measured cannot be used to advantage.

What is claimed is:

1. A bayonet-connection-undoing device comprising:

a projection configured for attachment to a hand so as to extend therefrom for depressing a pin to undo a bayonet connection; and a finger ring to which said projection is directly attached, said attachment makeable by wearing said ring on said hand, further comprising a hand glove, said ring being disposed inside said hand glove, with said projection emerging from said glove.

2. The device of claim 1, said projection being fixed to said ring.

3. The device of claim 2, said projection being formed integrally with said ring.

4. The device of claim 1, the extension being grip-wise inward.

5. A bayonet-connection-undoing device comprising:

a projection configured for attachment to a hand so as to extend therefrom for depressing a pin to undo a bayonet connection; and a hand glove from which said projection extends.

6. The device of claim 5, further comprising a ring to which said projection is attached, said ring being fixed to said hand glove.

7. A bayonet-connection-undoing device comprising:

a projection configured for attachment to a hand so as to extend therefrom for depressing a pin to undo a bayonet connection; and a finger ring to which said projection is directly attached, said attachment makeable by wearing said ring on said hand, said projection protruding with a length sufficient for said depressing flush with or below a surface that surrounds said pin, said surface being radially surrounded by a cylindrical device slotted for accommodating said pin in making said connection.

8. The device of claim 7, further comprising a glove, said projection having, at said glove, a base from which said projection extends, said length being such that said depressing brings a portion of said glove at said base flush with an outer surface of said cylindrical device.

9. A bayonet-connection-undoing device comprising:

a projection configured for attachment to a hand so as to extend therefrom for depressing a pin to undo a bayonet connection; and a finger ring to which said projection is directly attached, said attachment makeable by wearing said ring on said hand, said connection being a spring-loaded bayonet connection.

10. A bayonet-connection-undoing system comprising:

a bayonet-connection-undoing device comprising a projection configured for attachment to a hand so as to extend therefrom for depressing a pin to undo a bayonet connection;

sections of a pipe cleaner; and said connection, comprising said pin and configured for mutually fixing one of said sections to another, said depressing being down into a position at which said pin is retracted out of said connection and maintained, without need for said depressing by said projection, in a contracted state by relative movement of the sections, a section from among said sections having an L-shaped slot with a longitudinal leg and a transverse leg, said projection when applied having a length along said longitudinal leg not greater than that of said longitudinal leg exclusive of said transverse leg.

11. The device of claim 10, said pin, in making said connection, residing in a slot said projection is configured, in cross-section, for entering for said depressing.

12. A mould configured for forming a bayonet-connection-undoing device, said device comprising a projection configured for attachment to a hand so as to extend therefrom for depressing a pin to undo a spring-loaded bayonet connection, said mould being further configured for forming a finger ring to which said projection is fixed, said forming being such as to mutually form said ring and said projection integrally.

13. The mould of claim 12, said projection protruding with a length sufficient for said depressing flush with or below a surface that surrounds said pin, said surface being radially surrounded by a cylindrical device slotted for accommodating said pin in making said connection.

14. A bayonet-connection-undoing device comprising:

a finger ring; and a projection directly connected to said ring so as to extend from a hand wearing said ring, said device being configured with said projection for depressing a pin to undo a bayonet connection, further comprising a hand glove having an opening for said projection.

15. The device of claim 14, the extension being grip-wise inward.

* * * * *